United States Patent [19]

Cloostermans-Huwaert

[11] 4,405,385

[45] Sep. 20, 1983

[54] PROCESS OF TREATMENT OF A PRECIPITATION HARDENABLE AL-MG-SI-ALLOY

[75] Inventor: Leo Cloostermans-Huwaert, Maarkedal, Belgium

[73] Assignee: Societe Franco-Belge des Laminoirs et Trefileries d'Anvers "Lamitreff", Hemiksem, Belgium

[21] Appl. No.: 197,226

[22] Filed: Oct. 15, 1980

Related U.S. Application Data

[63] Continuation-in-part of Ser. No. 103,745, Dec. 14, 1979, abandoned.

[30] Foreign Application Priority Data

Dec. 14, 1978 [LU] Luxembourg ..... 80656

[51] Int. Cl.[3] ..... C22F 1/04

[52] U.S. Cl. ..... 148/11.5 A; 148/12.7 A

[58] Field of Search ..... 148/11.5 A, 12.7 A, 148/2, 11.5; 75/147, 148

[56] References Cited

U.S. PATENT DOCUMENTS

| | | | |
|---|---|---|---|
| 3,329,537 | 7/1967 | Loach | 148/11.5 A |
| 3,418,177 | 12/1968 | Pryor | 148/11.5 A |
| 3,613,767 | 10/1971 | Cofer et al. | 164/76 |
| 3,615,371 | 10/1971 | Nakajima et al. | 75/147 |
| 4,065,326 | 12/1977 | Nicoud | 148/2 |
| 4,151,896 | 5/1979 | Nicoud et al. | 148/11.5 A |

FOREIGN PATENT DOCUMENTS

| | | | |
|---|---|---|---|
| 55-110753 | 8/1980 | Japan | 148/11.5 A |
| 55-125252 | 9/1980 | Japan | 148/11.5 A |
| 55-145143 | 11/1980 | Japan | 148/11.5 A |
| 1323433 | 7/1973 | United Kingdom . | |

*Primary Examiner*—Peter K. Skiff

*Attorney, Agent, or Firm*—Edward J. Brenner

[57] ABSTRACT

The process relates to a thermo-mechanical treatment of a precipitation hardenable Aluminium-Magnesium-Silicon electrical conductor alloy, after rapid cooling for keeping alloying elements in solution. The alloy is rolled during quenching from a temperature range between hot working temperature and quenching temperature, down to more particularly the alloy is rolled during a quenching operation after hot rolling, to produce wire rods which need no solution treatment before further drawing into wire and where necessity of aging is strongly reduced or eliminated.

13 Claims, No Drawings

PROCESS OF TREATMENT OF A PRECIPITATION HARDENABLE AL-MG-SI-ALLOY

This application is a continution-in-part application of Ser. No. 103,745 filed Dec. 14, 1979 abandoned.

BACKGROUND OF THE INVENTION

The invention relates to a process for shaping of a precipitation hardenable non-ferro alloy into wire rod suitable as starting material for drawing into electrical conductor wire. By a Al-Mg-Si alloy is meant. The alloy is said to be "precipitation hardenable", when it comprises alloying elements which can supersaturate the crystal lattice when the alloy is quenched from a temperature at which these elements are dissolved in the alloy, and which can afterwards be precipitated out of the crystal lattice by means of an ageing treatment at medium temperature, so causing a hardening by precipitation, as well known by those skilled in the art. In general an Al-Mg-Si alloy for electrical conductor wire, has a composition of 0.3 to 0.9% of magnesium, 0.25 to 0.75% of silicon, 0 to 0.60% of iron, the balance being aluminium and impurities (i.e. elements in a quantity of less than 0.05%).

In order to give the alloy the final wire form, this alloy is in general hot and/or cold worked. Hot working is working at a temperature where the structure can recrystallize according as it is worked, whereas cold working is working below that temperature. For the finally obtained electrical conductor wire it is also desirable to obtain certain optimal properties, i.e. a high tensile strength coupled with an acceptable and a high electrical conductivity, but with the existing mechanical and heat treatments such property combinations are not always compatible, and the treatments to obtain certain combinations are not always simple. The problems in relation herewith will be explained in relation with the manufacturing of electrical conductor wire made of alloy Al-Mg-Si above, for which the specifications are very stringent in relation to minimum tensile strength, ductility and electrical conductivity in combination, and where there is no large choice in the processes to reduce the wire rods suitable as starting material for drawing into electrical conductor wire which will meet theses specifications.

usually, the manufacturing of a wire of such electrical conductor alloy is in a conventional way conducted in a number of steps: firstly the alloy is entered, either after continuous casting on a casting wheel, or in the form of discontinuous cast bars, into a rolling mill whilst at a hot working temperature of about 490° to 520° C., in order to produce at the exit end of the rolling mill wire rods of a diameter of 5 to 20 mm, in most cases between 7 and 12 mm. However, during rolling the alloy has cooled down to about 350° C. This means that the greater part of magnesium and silicon, introduced to conduct a precipitation hardening treatment at the very end of the manufacturing, is already prematurely precipitated and lost for the hardening.

For this reason, the second manufacturing step is a solution treatment after rolling. Bobbins of wire rods are so kept in a furnace for a number of hours at a temperature of 500° to 520° C. for dissolving the precipitates again in the crystal lattice. Immediately thereafter, the bobbins of wire rods, at the solution treatment temperature, are quenched to a temperature below 260° C., in which the structure is stuck in the state where the alloying elements in solution stay in supersaturated solution in the crystal lattice. This quenching temperature is most often room temperature. Subsequently, these wire rods are cold drawn, which gives a high tensile strength, but strongly reduces ductility to an unacceptable level. For that reason, after drawing, the wire is submitted to an ageing treatment with precipitation hardening, by keeping the wire during a few hours at a temperature of about 145° C. This brings ductility to an acceptable level, with a considerable gain of tensile strength, because the loss due to the softening of the dislocated structure is largely compensated by the precipitation hardening. This is the reason why the alloying elements had to stay as much as possible in solution until the end, in order to allow them to participate as much as possible to the precipitation hardening. Additionally, this ageing step, as it removes internal tensions by the rearrangement of dislocations and by expelling the alloying elements out of supersaturation, is very beneficial for improving the electrical conductivity, which dropped during quenching and drawing, due to the increase of internal tensions.

It has been tried to obtain simpler methods whilst obtaining other, but still acceptable property combinations. In particular, this conventional process requires a solution treatment at very high temperature during many hours, and this is an important factor in the cost price, and consequently it has been tried to eliminate this treatment. All these attempts have as a common goal, that at the exit of the rolling-mill the wire would still have such high temperature, that none or only a small part of the alloying elements should already be precipitated, so that the wire rods can directly be quenched at the exit of the rolling-mill and then, most of the alloying elements are still in solution and can participate to the precipitation hardening afterwards. It has so been proposed to use a very high entrance temperature into the rolling-mill, or a very high throughput speed through the rolling-mill, or an intermediate heating between rolling steps. In the first case, the material is too soft for rolling due to some still liquid eutectic compounds between the crystal grains, in the second case the speed is too high for use together with a continuous casting wheel, or other system of feeding the rolling-mill and in the third case the intermediate heating complicates the rolling step.

DESCRIPTION OF THE INVENTION

In general terms, apart from the specific shape of the product which is to be obtained, or the specific alloy which is used, it is the object of the invention to provide a method of producing wire rods of precipitation hardenable Al-Mg-Si alloys, which are suitable for drawing into electrical conductor wire and which provides new possibilities to obtain wire with combinations of properties which are not always obtainable in a simple way by existing treatments owing to the special metallographic structure of the wire rods, having a minimum tensile strength of at least 25 $Kg/mm^2$ and a conductivity of at least 52% IACS in the as rolled unaged condition. More in particular, with respect to the prior art where the properties are obtained after a hot working step, followed by solution treatment and quenching, and finally cold working and ageing, it is a further object of the invention to provide an alternative method which does not need any solution treatment, especially in the case of obtaining electrical conductor wire of the Al-Mg-Sicomposition above and where, in certain cases, the ageing treatment can be eliminated also, because the effect of ageing is then obtained in another way.

In the above prior art, no care was taken to what could be done with the alloy when cooling down after hot working, especially to what could be done in the range of "semi-hot" temperatures. This is the range between the temperatures of hot working, i.e. the temperatures where the structure recrystallizes according as it is worked, and the temperatures of quenching, i.e. the temperatures where the atoms in the structure are sufficiently immobilized to have an unalterable metallographic structure, apart from ageing phenomena. This range will be determined more in general and in detail hereunder, but for the abovementioned Al-Mg-Si electrical conductor wire compositions, this range lies between about 260° C. and about 340° C.

In the prior art, passing through this range was in the form of a pure quenching, so that an intermediate product was obtained which has a structure with recrystallized grains, as it was hot rolled, and has a maximum of alloying elements in supersaturated condition. In the invention however the attention is drawn to what can be done inside said range, namely working during the quenching. In the invention, independently from how the alloy was treated before, one will provide a rapid cooling down step, as from a temperature inside the range of semi-hot temperatures towards a quenching temperature, in which the alloy is rolled. The result is, that the intermediate product that is now obtained, has a specific grain structure which appears to be a good structure for obtaining good properties after cold working and, if necessary, ageing.

During working inside said range indeed, the grains are deformed and take an oblong shape, whilst the dislocations run through the grain which is so subdivided in a number of subgrains which differ from each other by a slight difference of orientation of the crystal lattice. This structure is not destructed according as the alloy is worked, because the material is in the temperature range below hot working temperature where this occurs. As an Al-Mg-Si alloy is used where the alloying elements for precipitation hardening precipitate for a substantial part, there is formation of very small precipitates invisible in the optical microscope, which preferentially come to anchor the above dislocations. Consequently, it will be preferred to use alloying elements which are for a substantial part, i.e. for at least 5%, soluble in the alloy at the upper limit of said range. This is the case of the abovementioned Al-Mg-Si electrical conductor wire alloy.

It is further important that the obtained structure be not destroyed afterwards under influence of an excessive further addition of temperature-time energy, i.e. a too high mobility of the atoms during a too long duration of the remainder of the cooling-down step. Consequently, the cooling-down step must be sufficiently rapid to avoid this, and that is what is meant by a "rapid" cooling down step. When precipitates are formed during the cooling-down step, this step will be sufficiently rapid when it is sufficiently short to avoid that precipitates of a dimension of more than 1 micron be formed, apart from the precipitates which may have been germinated before, e.g. during a preliminary cooling down or working step, and have further grown by coalescence over a dimension of 1 micron. Because then these alloying elements and large precipitates are lost for the formation of the final structure with very fine precipitates, formed during working inside the range of semi-hot temperatures or in a final ageing step afterwards.

It is clear that avoiding an excessive coalescence of the precipitates is not a question of time alone or of a temeprature alone, but of a combination of time and temperature which procures sufficient energy to mobilize the small precipitates to coagulate. Similarly, it is clear that the dimension of 1 micron is not an absolute limit, but only serves to determine an order of magnitude.

The range of "semi-hot" temperatures is determined by the range between the lower temperature limit for hot working and the upper temperature limit for quenching the structure. Hot working is working whilst the structure is allowed, according as the material is deformed and work-hardened, to settle again by recrystallization to soften with a view to the subsequent deformations which constitute the working. For a given alloy, the range of usable temperatures for hot working is not strictly limited. The lower limit is set by the possibility of sufficient intermediate recrystallization between the hot working deformations to avoid substantial work-hardening, and this limit for each alloy is sufficiently known by those skilled in the art. For instance, for the abovementioned Al-Mg-Si electrical conductor wire alloy composition this lower temperature limit for hot working lies around 340° C. On the other hand, a temperature for quenching the structure is a temperature at which the mobility of the atoms is so low that the structure gets practically stuck in the state as it is: the atoms which are not yet expelled out of solution from the crystal lattice will so remain in the lattice in supersaturation, the precipitates stay where they are, and the state and form of the dislocations remain as they are, without recrystallization. For a given alloy, the range of usable temperatures for quenching is not strictly limited. The upper limit is set by a sufficient immobility of the atoms to avoid a sufficiently rapid and sensible modification of the structure, apart from ageing phenomena, and this limit for each alloy is sufficiently known by those skilled in the art. For instance, for the abovementioned Al-Mg-Si electrical conductor wire alloy composition this upper limit for quenching lies around 260° C.

As already mentioned, when the structure is worked inside the range of semi-hot temperatures, but takes too much time thereafter to reach a quenching temperature, then this structure is destroyed. This time is used for continuing to work the alloy during the total duration of said rapid cooling down step. When the quenching temperature is reached, the structure can further cool down to room temperature, with or without ageing phenomena, and then the product is ready for further cold working into the desired shape.

The desired specific structure is obtained in the cooling step inside said range of semi-hot temperatures, apart from what happens before. It is however preferable that rolling inside this range can start with a maximum possible of alloying elements in solution, so that the latter be not lost, by premature precipitation, either for precipitation in the manner above during such working, or thereafter in an ageing step. To that end and the said cooling down step is preceded by a preliminary cooling down step as from a preferably a temperature of substantial solubility of the alloying elements, i.e. a temperature in a range where at least half of the alloying elements which enter into account for precipitation hardening are soluble. For the abovementioned Al-Mg-Si electrical conductor wire composition, the lowest limit for this range lies about 470° C. It is further clear that this preliminary cooling down step shall be sufficiently rapid, otherwise these alloying elements would precipitate before the start of working inside said range of semi-hot temperatures. Preferably the alloy is hot worked during this preliminary cooling down step.

In general, this preliminary cooling down step directly follows an initial hot working step of which preferably, in order to have a maximum of alloying elements in solution, the starting temperature is a temperature of substantial solubility of the alloying elements, and where the temperature remains in the range for substantial solubility of the alloying elements.

As it is now desired to obtain wire rods the working operations during the initial hot working step, the preliminary cooling down step, and the cooling-down step towards quenching temperature can be obtained by extrusion or rolling, although rolling is preferred. The three working operations can then take the form of an operation inside a same continuous multiple pass rolling machine, where the initial units are taken for initial hot rolling, the intermediate units for rolling in the preliminary cooling down step, and the final units for rolling inside the cooling down step towards quenching temperature. In the initial units for initial hot working, much cooling down is not desirable in order to keep a maximum of alloying elements in solution, and even intermediate heating can be applied, whereas the intermediate and final units it is desirable to provoke a rapid cooling for the reasons given above. It is for that reason that in the continuous multiple pass rolling mill two parts can be distinguished: in the initial part, reserved for the initial hot working step, the cooling of the rolling units is kept to a minimum, and even intermediate heating can be applied, in order to keep the temperature at a temperature for substantial solubility of the alloying elements, and in the final part, reserved for the preliminary cooling down step and the immediately following cooling-down step towards quenching temperature, the cooling of the rolling units is very strong, so that these cooling down steps are sufficiently rapid in the sense that was given above: to avoid precipitation to excessive dimensions and obtain the specific metallographic structure without possibility of recrystallization. In such a way, wire rods are obtained with good metallographic structure for further drawing into wire without intermediate heat treating step, followed, if necessary, by ageing. The product that enters the rolling mill can be a bar or block, but will preferably be a continuous string that leaves a continuous casting machine. In this way, there is a minimum of heat energy lost and the alloying elements are for a vast majority in solution. If the string would cool too much, or in order to keep a maximum of alloying elements in solution, the string can be heated up on its way towards the rolling mill, but without reaching melting temperature, namely the temperatures where the eutectic compounds at the grain boundaries begin to soften, which would prevent good rolling. The string can be given a circular cross-section.

The invention is directed to the manufacturing of wire rods for Al-Mg-Si electrical conductor wire of the composition above. Following the prior art, after continuous casting of the alloy to form a solidified continuous string which leaves the casting wheel at a temperature where the alloying elements are still in solution, this string is continuously and immediately directed towards a multiple pass continuous rolling mill in which two parts can be distinguished. In the first part where the cross-section of the string is reduced, preferably about half of the number of passes, the cooling is brought to a minimum in order to avoid an excessive precipitation, because the precipitates first formed have more time to conglomerate, and so the temperature is kept at a temperature of substantial solubility of the alloying elements, which is for these alloying compositions at least 470° C. In the second part, the cooling is so strong that the temperature directly passes from a temperature of substantial solubility of the alloying elements towards a quenching temperature which for these alloy compositions lies below 260° C. In doing so, the temperature traverses the range of semi-hot temperatures, in which the above explained structure is formed, and cools further down, still whilst being worked, towards a quenching temperature. Final rolling below said range of semi-hot temperature has the function of cold working before drawing, but the important point is, that the structure be sufficiently cooled down to avoid that the specific subgranular structure be not destroyed. The wire rods so obtained, in general of a diameter of 7 to 10 mm, have then a good metallographic structure for further drawing and giving acceptable properties, without the need of intermediate solution treatment.

The rapid cooling over the final passes will be a cooling from above 470° C. to below 260° C., so that a quenching must occur to cool down by more than 210° C. over the final passes. This is an average cooling rate of more than 50° C. per second. The alloy entering the rolling mill will preferably be a continuous cast string, but it can also be a bar or other form, and the cast string can also, when leaving the casting wheel towards the rolling mill, be submitted to intermediate heating.

The alloy used in the example is an Al-Mg-Si alloy of the type 6201 having as composition: Mg: 0.50%; Si: 0.46%; Fe: 0.14%; Zn: 0.006%; Cu: 0.004%; Mn: 0.015%; Ti: 0.001%; V: 0.004%. In this alloy, the alloying elements which substantially precipitate in the semi-hot zone are magnesium and silicon. Iron, although present for a comparatively high percentage, doesnot play a prominent part, because it precipitates too rapidly before reaching the semi-hot zone.

Four samples of this alloy have been treated. All four, after leaving continuous casting in the form of a string of a thickness of 40 mm, are entered, at a temperature of about 500° C., into a continuous 13-pass rolling mill, which they leave in the form of wire rods with a diameter of 9.5 mm. The output speed of the wire rods from the rolling-mill is 3 m per second. In the four cases however, the cooling down is different: for the three former specimens, the 6 first passes of the rolling-mill consume a minimal of cooling liquid, of the order of 5 $m^3$ per hour, such that the wire leaves the sixth pass at a temperature of about 480° C. During the 7 last passes, different consumptions of cooling liquid are used up to 30 $m^3$ per hour, in dependence of the desired exit temperature, which is of 140° C., 180° C. and 250° C. respectively for the three specimens Nos. 1, 2 and 3. These wire rods are then coiled up as starting material for cold drawing and ageing afterwards. The fourth sample is treated in the conventional way: rolling as from a temperature of about 500° C. with an equal consumption of cooling liquid over all the passes of about 10 $m^3$ per hour, to obtain an exit temperature of the wire rods of about 350° C. These wire rods are then, after coiling up, submitted to a solution treatment in a furnace at 530° C. during 10 hours and immediately thereafter rapidly cooled to room temperature to produce sample No. 4, of the same diameter of 9.5 mm.

These four samples are subsequently drawn, without intermediate heat treatment, so as to obtain a wire of about 3.05 mm and subsequently submitted to an ageing treatment at 145° C. during 10 hours.

In the results, given in tables I to III hereunder, the values indicated under "WR" are values measured on the wire rods before drawing, the values "AD" are values measured on the wire after drawing and before ageing, and the values A1, A3 to A10are values measured on the drawn wire after ageing during 1 hour, 3 hours, until 10 hours, in order to follow the effect of the ageing treatment.

TABLE I

| | | | Tensile strength in kg/mm² and elongation in % (abbreviated R and A respectively) | | | | | |
|---|---|---|---|---|---|---|---|---|
| Sample | WR | AD | A1 | A3 | A5 | A7 | A9 | A10 |
| 1 | 23.31-5 | 30.79-4 | 31.64-5 | 33.48-6.8 | 34.58-7 | 34.74-6.5 | 35.24-6.75 | 35.15-6.75 |
| 2 | 28.26-7 | 34.98-4 | 34.00-4.8 | 33.82-5 | 34.02-5 | 33.63-5 | 33.41-5 | 33.45-4.75 |
| 3 | 26.52-6 | 30.52-4,5 | 29.59-4.8 | 29.17-4.8 | 29.11-5.25 | 28.65-4.75 | 28.39-4.25 | 28.38-4.25 |
| 4 | 17.51-21 | 28.75-4,5 | 31.26-7.5 | 32.51-8.5 | 33.07-7.75 | 33.34-8 | 34.24-8.75 | 34.11-8 |

TABLE II

| | Resistivity in milliohms mm²/m | | | | | | | |
|---|---|---|---|---|---|---|---|---|
| Sample | WR | AD | A1 | A3 | A5 | A7 | A9 | A10 |
| 1 | 32.89 | 33.09 | 32.66 | 32.19 | 32.00 | 31.71 | 31.63 | 31.42 |
| 2 | 31.20 | 32.23 | 31.07 | 30.88 | 30.77 | 30.39 | 30.34 | 30.42 |
| 3 | 31.44 | 29.95 | 29.85 | 29.78 | 29.78 | 29.50 | 29.66 | 29.50 |
| 4 | 33.36 | 33.56 | 32.98 | 32.62 | 32.19 | 32.19 | 32.04 | 32.01 |

In table I, sample No. 1 is the nearest one to conventional sample No. 4. But what is important in this case is that, firstly, the specifications ESE 78 ($R>33$ kg/mm² and $A>4\%$) are still reached without the expensive solution treatment. Furthermore, one canobserve that for sample No. 2, aging no longer modifies the mechanical properties, so that in this case it can also be eliminated. This is due to an ageing effect on the subgranular structure during further air cooling on the coil towards room temperature, so that no further ageing is necessary. This gives that the advantage that such wire rods after rolling, and awaiting the drawing operation sometimes for weeks, are no more susceptible to natural ageing, so that the properties at delivery are the same as after manufacturing. And this sometimes eliminates the necessity to conduct an interemdiate ageing operation on the wire rods after manufacture. Finally, when looking at Table II, it can be observed that conductivity is about 5% better, which allows the user to make 5% material savings.

Still observing Table II, one can seen that sample No. 3 is by far the best one with respect to conductivity. If tensile strength is of less importance, the process can be controlled to obtain such a product. For this specimen No. 3, the quenching in the second part of the rolling-mill has been less rapid, and the subgranular structure already for a small part destroyed, with precipitates which could grow a little more, and this explains the inferior mechanical properties and the good conductivity.

For sample No. 1, the quenching in the second part was very rapid. Here only a part of the alloying elements could precipitate in the desired manner, but another part is left in oversaturation. This is the reason why this sample still sensible to ageing. It takes so advantage, partly from the conventional method, and partly from the advantages of the structure of the invention, which gives a very good combination of mechanical and electrical properties, and nevertheless needs a final ageing step, but still avoids the expensive solution treatment step.

The method according to the invention, gives in that manner a good means to control the production of different combinations of properties, according to the desired application in the electrical field when the exit temperature from the rolling-mill is not lower than 140° C. and not higher than 200° C. as in samples 1 and 2 according to the invention, then the optimum combination of tensile strength and conductivity are reached.

Still considering samples 1 and 2, it has been mentioned that sample 1, worked under quenching to 140° C., was still partly supersaturated. When cold drawn afterwards, the subsequent ageing treatment at 145° C. during 10 hours shows clearly the effect of precipitation of the alloying elements in supersaturation. The effect of ageing can however more rapidly been achieved by replacing the cold drawing and ageing heat treatment by drawing at ageing temperature, between 135° and 155° C. The effect of the mechanical treatment during the time that the wire is at ageing temperature, is that the ageing goes much faster, and is completed at the end of the cooling down after drawing. This also allows to eliminate the long ageing heat treatment.

In sample 2 however, worked under quenching to 180° C., the alloying elements are practically all precipitated in the special subgrain structure, during working, and also by an ageing effect on the coil where the sample further cooles down to room temperature. When cold drawn afterwards, the subsequent ageing treatment shows no ageing effect because the precipitates are anchored in the structure. Further ageing becomes however possible, when desired for obtaining a better ductility or electrical conductivity, by drawing at ageing temperature as for sample 1.

It is also possible to obtain an alternative of sample 2, still worked under quenching to 180° C., but which at the exit of the rolling-mill is rapidly further cooled down to below 100° C., instead of cooling slowly down on the coil towards that temperature. The result is that any ageing effect during slow cooling down on the coil is avoided, and that the state of ageing is less advanced. Such less advanced state can also be obtained by working under quenching to a temperature higher than 180° C., but the cooling down more rapidly, as the status of aging is a question of mobility of the atoms (or temperature) and time for the atoms to move. When such sample in less advanced state of aging is submitted to drawing at aging temperature, the result will be a further aging but to a less advanced state than for sample 2.

It can so be concluded that further drawing at aging temperature, preferably between 140° and 150° C., with or without preliminary quenching to below about 100°

C., provides further possibilities to modify the combinations of properties of the alloy if desired.

As already mentioned, the temperature of the above-mentioned Al-Mg-Si alloy when entering, and during the initial hot working or hot rolling step will be above the temperature of substantial solubility of the alloying elements, which for this alloy is about 470° C., although this is no absolute limit and depends on the exact composition. As an example, for different compositions, complete solution or homogenization is reached at the following temperatures: for 0.6% Mg and 0.6% Si: 520° C.; for 0.6% Mg and 0.4% Si: 500° C.; for 0.4% Mg and 0.6% Si: 490° C.; for 0.4% Mg and 0.4% Si: 470° C. When entering the hot alloy at the preferred temperature of 500° C. to 530° C., the largest majority of the alloying elements will still be in solution, without danger of melting of the alloy. The temperature shall indeed be not more than 550° C., because the eutectic compounds Al-$Mg_2$-Si and Al-Si-$Mg_2Si$ only solidify at 585° C. and 550° C. respectively.

The wire rods, after exit from the rolling mill, will have in general the form of a rolled string, in general of a diameter of 7 to 10 mm, and with a metallographic structure with elongated grains obtained from rolling, and divided into sub-grains of which the boundaries are formed by the dislocations as explained above. When alloying elements are used for precipitation, these elements will be present in the alloy in the form of at least 20, 30, 40 or 50% of small precipitates, invisible in the optical microscope or at least smaller than 1 micron, because the larger precipitates are lost for further improvement of the properties.

The rolling operation must not necessarily be a continuous rolling after continuous casting. One can use, for instance, a rolling which starts with a reduction of blooms or wire bars, and where the so formed strings are welded by their ends together according as they leave this rolling step, and the so formed long string can then be continuously entered in a multipass continuous rolling mill.

I claim:

1. A process for shaping of a precipitation hardenable Al-Mg-Si alloy into wire rod suitable as starting material for drawing into electrical conductor wire and having a minimum strength of at least about 23 Kg/$mm^2$ and minimum conductivity of at least about 52% IACS in the as-rolled, unaged condition, which process comprises:

(a) submitting the alloy to a rapid preliminary cooling-down step from a temperature of substanital solubility of the alloying elements towards a temperature inside the range of semi-hot temperatures, and (b) then rolling said alloy immediately thereafter whilst rapidly cooling down from said temperature inside the range of semi-hot temperatures towards a temperature at the exit of the rolling-mill, this temperature being at least 140° C. and not higher than 200° C., this step being sufficiently short to avoid the formation of precipitates of a dimension of more than 1 micron.

2. A process according to claim 1 in which the alloy is rolled as from a temperature of substantial solubility towards said temperature at the exit of the rolling-mill.

3. A process according to claim 2, in which, before the alloy is made to rapidly cool down as from said temperature of substantial solubility, the alloy is submitted to an initial hot working step in which the temperature of the alloy remains inside the range for substantial solubility of the alloying elements.

4. A process according to claim 3, in which the working is carried out by continuously rolling the alloy in a same continuous multiple-pass rolling mill in which two parts can be distinguished: a first part for said initial hot working step in which the cooling of the alloy is unsufficient to allow the alloy to come below the temperature limit for substantial solubility of the alloying elements, and a second final part, in which the alloy is rapidly cooled down towards a quenching temperature.

5. A process according to claim 4, in which the alloy is subsequently cold drawn without intermediate heat treatment.

6. A process according to claim 5, in which the alloy is subsequently submitted to an ageing treatment.

7. A process according to claim 4, in which said initial hot working is preceded by continuous casting of the alloy into a string which continuously moves towards the entrance of the continuous multiple-pass rolling mill at a temperature for substantial solubility of the alloying elements.

8. A process according to claim 7, in which said string is heated, without reaching melting temperature, on its way to the rolling mill.

9. A process of manufacturing wire rods of a precipitation hardenable aluminium alloy comprising 0.3 to 0.9% of magnesium, 0.25 to 0.75% of silicon, 0 to 0.60% of iron, the balance being aluminium and impurities, said rods having a minimum strength of at least about 23 Kg/$mm^2$ and minimum conductivity of at least about 52% IACS in the as-rolled, unaged condition, the process comprising:

(a) introducing said alloy, at a temperature of at least 470° C., in a continuous multiple pass rolling mill, (b) continuously rolling said alloy in an initial number of passes in said rolling mill, at a temperature above about 470° C., and (c) further continuously rolling said alloy, in a final number of passes in said rolling mill, whilst rapidly cooling down said alloy from a temperature above 470° C. towards a temperature at the exit of the rolling mill, which is at least 140° C. and not higher than 200° C.

10. A process according to claim 9, in which the alloy is subsequently drawn at a temperature between 135° C. and 155° C.

11. A process according to claim 9, in which the alloy, on exit from the rolling mill, is immediately quenched to a temperature below 100° C.

12. A process according to claim 9 in which said alloy which is introduced into said rolling mill is a continuous cast string at a temperature between 500° C. and 530° C.

13. A process according to any one of claims 1 to 8, in which the alloy is an Al-Mg-Si alloy comprising 0.3 to 0.9% of magnesium, 0.25 to 0.75% of silicon, 0 to 0.60% of iron, the balance being aluminum and impurities, in which said range of semi-hot temperatures ranges between about 340° C. and 260° C., and the range for substantial solubility of the alloying elements has a lower limit of about 470° C.

* * * * *